US006190469B1

(12) United States Patent
Koh et al.

(10) Patent No.: US 6,190,469 B1
(45) Date of Patent: Feb. 20, 2001

(54) METHOD FOR MANUFACTURING HIGH STRENGTH AND HIGH FORMABILITY HOT-ROLLED TRANSFORMATION INDUCED PLASTICITY STEEL CONTAINING COPPER

(75) Inventors: Hyang Jin Koh; Nack Joon Kim; Sung Ho Park, all of Pohang (KR)

(73) Assignee: Pohang Iron & Steel Co., Ltd. (KR)

( * ) Notice: Under 35 U.S.C. 154(b), the term of this patent shall be extended for 0 days.

(21) Appl. No.: 09/101,147

(22) PCT Filed: Jan. 11, 1997

(86) PCT No.: PCT/KR97/00215

§ 371 Date: Jul. 1, 1998

§ 102(e) Date: Jul. 1, 1998

(87) PCT Pub. No.: WO98/20180

PCT Pub. Date: May 14, 1998

(30) Foreign Application Priority Data

Nov. 5, 1996 (KR) ..... 96-52002

(51) Int. Cl.[7] ..... C21D 11/00; C21D 9/52

(52) U.S. Cl. ..... 148/500; 148/602; 148/654

(58) Field of Search ..... 148/500, 602, 148/654

(56) References Cited

FOREIGN PATENT DOCUMENTS

| | | | |
|---|---|---|---|
| 0585843 | | 3/1994 | (EP) . |
| 357137426 | * | 8/1982 | (JP) . |
| 57-137426 | * | 8/1982 | (JP) . |
| 62-188729 | | 8/1987 | (JP) . |
| 4-228517 | | 8/1992 | (JP) . |
| 4-04329848 | * | 11/1992 | (JP) . |
| 5-112846 | | 5/1993 | (JP) . |
| 5-179396 | | 7/1993 | (JP) . |
| 5-311323 | | 11/1993 | (JP) . |
| 6-145788 | | 5/1994 | (JP) . |
| 6-145892 | | 5/1994 | (JP) . |

OTHER PUBLICATIONS

Hanai, Satoshi et al., "The Manufacture of Si–Mn As–hot–rolled Dual Phase Steel Sheets", *ISIJ,* vol. 68, pp. 1306–1312, 1982 no month.

Sudo., Masatoshi et al., "Deformation Behavior and Mechanical Properties of Ferrite Plus Bainite Plus Martensite (Triphase) Steel", *ISIJ,* vol. 68, pp. 1185–1194 1982 no month.

Sudo, Masatoshi, et al., "Niobium Bearing Ferrite–Bainite High Strength Hot–rolled Sheet Steel with Improved Formability", *Transactions ISIJ,* vol. 23, 1983, pp. 303–311. no month.

(List continued on next page.)

*Primary Examiner*—Roy V. King
*Assistant Examiner*—Tima McGuthry-Banks
(74) *Attorney, Agent, or Firm*—Webb Ziesenheim Logsdon Orkin & Hanson, P.C.

(57) ABSTRACT

A method for producing a high strength hot-rolled steel sheet with good formability applicable to automobiles, industrial machines and the like is disclosed. The basic composition of TRIP steel is adjusted wherein Cu is added to improve the strength by precipitation hardening of a fine ϵ—Cu. Other conditions are controlled to obtain a tensile strength of over 90 kg/mm$^2$ with good formability. The steel is composed of 0.15–0.3% by weight of C, 1.5–2.5% by weight of Si, 0.6–1.8% by weight of Mn, 0.02–0.10% by weight of Al, 0.6–2.0% by weight of Cu, 0.6–2.0% by weight of Ni, the balance being Fe and inevitable impurities and has a microstructure of multi-phase structure consisting of ferrite, bainite, and retained austenite, or a granular structure (M-A constituents in bainitic ferrite matrix). The steel is finish rolled at a temperature of 750–880° C., water cooled from a water cooling initiation temperature of 680–740° C. to a water cooling termination temperature of 240×(% Mn+% Ni)−140 (° C.) to 540° C., and subsequently coiled at this temperature.

5 Claims, 6 Drawing Sheets

OTHER PUBLICATIONS

Nagao, Noriaki et al., "Development of Formable 700Mpa Grade Hot Rolled High Strength Sheet Steels", *CAMP–ISIJ,* vol. 1, 1988, p. 608 (w/English translation–2pp.) No month.

Hoshino, Toshuki et al., "Microalloyed steels with cold–forging, machinability, and tempering properties for fatigue–resistant machine parts", *Chemical Abstracts,* vol. 124, No. 14, Apr. 1, 1996, p. 405, col. 1, abstract No. 182272z.

Katsu, Shinichiro et al., "Microalloyed steel for hot–rolled corrosion–resistant sheets with fatigue resistance at welds", *Chemical Abstracts,* vol. 124, No. 4, Jan. 22, 1996, p. 306, col. 2, abstract No. 34384x.

Shirasawa, Hidenori et al., "Manufacture of hot–rolled steel sheets having strength $\lesssim$ 590N/mm$^2$ with excellent fatigue properties and formability", *Chemical Abstracts,* vol. 121, No. 16, Oct. 17, 1994, p. 345, col. 2, abstract No. 184491g.

Nomura, Shigeki et al., "Manufacture of hot–rolled steel sheets having good workability", *Chemical Abstracts,* vol. 118, No. 6, Feb. 8, 1993, p. 273, col. 1, abstract No. 43266p.

Metals Handbook, Ninth Edition, vol. 4: Heat Treating. 1981 pp. 31 and 41.*

* cited by examiner

METHOD FOR MANUFACTURING HIGH STRENGTH AND HIGH FORMABILITY HOT-ROLLED TRANSFORMATION INDUCED PLASTICITY STEEL CONTAINING COPPER

This application is a national stage of PCT/KR97/00215, filed Apr. 11, 1997.

BACKGROUND OF THE INVENTION

1. Field of the Invention

The present invention relates to a method for manufacturing a hot-rolled steel sheet with high strength and high formability applicable to automobiles, industrial machine and the like. More specially, this invention relates to a method for manufacturing a hot rolled TRIP (Transformation Induced Plasticity) steel containing copper (Cu) with high strength and high ductility.

2. Description of the prior art

Generally a high strength hot-rolled steel sheet with high formability has been widely used in manufacturing automobiles. And order to make the automobile steel sheet lighter and ensure safety at collisions, steel sheets with a higher strength have been greatly demanded.

This kind of hot-rolled high strength steel sheet is widely used in making automobile driving wheels. The effect of weight reduction in the components used in the driving system, like driving wheels, is higher by 3 times than the body panel. Further, the weight reduction greatly depends on the high strength, and therefore, a high strength steel sheet is increasingly demanded.

Since the components such as driving wheels are formed into the final product through a complicated press-forming procedure, the steel used for them has been required to have superior formability.

Research has been encouraged to produce new types of hot rolled steels with higher strength without significant loss so ductility. As a result, dual phase steel composed of either ferrite and martensite or ferrite and bainite, and triphase steel composed of ferrite, martensite and bainite were developed, the strength of which reaches 60 kg/mm$^2$ and the elongation 30%.

The methods for producing these steels have been proposed as described in the following examples;

1. A steel containing 0.06–0.1% by weight of C, 0.25–1.3% by weight of Si, and 1.1–1.5% by weight of Mn is coiled at a temperature of 300° C. or below, thereby producing a dual phase steel composed of ferrite and martensite (Testu-to-Hagane, vol. 68(1992), p.1306).

2. A steel containing 0.04–0.06% by weight of C, 0.5–1.0% by weight of Si, and 1.5% by weight of Mn, is added with 0.5–1.5% by weight of Cr. This steel is rolled at about 850° C., then coiled at about 200° C. Thus a triphase steel is produced, of which the microstructure consists of 10–20% by volume of bainite and 3–5% by volume of martensite in ferrite matrix. (Testu-to-Hagane, vol. 68(1992), p.1185).

3. A steel containing 0.05–0.07% by weight of C, 0.5% or less by weight of Si, 1.1–1.5% by weight of Mn, is added with 0.04% or less by weight of Nb. Dual phase steel containing 1–20% by volume of bainite phase in ferrite matrix is produced, and in which the tensile strength is the order of 60 kg/mm$^2$. (Trans. ISIJ, vol.23(1983), p.303).

4. A steel having compositions similar to that of item 3 is added with 0.04% and 0.06% by weight of Nb and Ti based on the item 3. The ferrite-bainite dual phase steel with tensile strength of 70 kg/mm$^2$ is produced. (CAMP-ISIJ, vol.1(1988) p.881).

If the strength of the aforementioned steels is improved, however, the ductility is drastically decreased. For example, if the tensile strength is enhanced to 90 kg/mm$^2$, the ductility is dropped to less than 20%. The formability, therefore, is drastically aggravated.

Using the concept of TRIP (Transformation Induced Plasticity) phenomena observed in austenitic steel, however, the combination of high strength and high formability can be obtained. Thus, the steels containing retained austenite possess superior combination of high strength and high formability owing to the strain induced transformation of retained austenite to martensite during deformation.

If the process conditions are optimized, the steel containing retained austerite shows a good combination of strength and ductility with a tensile strength up to 80 kg/mm$^2$ and an elongation of 30%. In this regard, various techniques have been proposed.

1. Japanese patent laid-open No. Hei-6-145892 discloses a steel containing 0.06–0.22% by weight of C, 0.05–1.0% by weight of Si, 0.5–2.0% by weight of Mn, 0.25–1.5% by weight of Al, and 0.03–0.3% by weight of Mo. Thus the volume fraction of retained austenite reaches 3–20%, and a tensile strength of 50 kg/mm$^2$ and an elongation of 35% are obtained. The steel shows a prominent press formability, high deep drawability, and superior bendability.

2. Japanese patent laid-open No. Hei-6-145788 discloses a steel in which the Al content of the steel of Japanese patent laid-open No. Hei-6-145892 is adjusted to the range of 0.6%×Si and 3–12.5%×C. The steel is annealed at 600–950° C. for 10 seconds to 3 minutes, which is ferrite/austenite two phase region, cooled down to 350–600° C. at a cooling raze of 4–200° C./sec, and isothermally held at this temperature for 5 seconds to 10 minutes. The steel, in turn, is cooled down to below 250° C. at a cooling rate of 5° C./sec or more, thereby obtaining steels with high formability.

3. Japanese patent laid-open No. Sho-62-188729 discloses that a steel containing 0.15–0.3% by weight of C, 0.5–2.0% by weight of Si, 0.2–2.5% by weight of Mn, 0.1% or less by weight of Al, and 0.05–0.5% by weight of Cr (if necessary) is annealed ferrite/austenite two phase region (730–920° C.) for 20 seconds to 5 minutes, cooled down to a temperature of 650–770° C. at a cooling rate of 2–50° C./sec, isothermally held at this temperature for 5 seconds to 1 minutes, and then cooled down to a temperature of 300–450° C. at a cooling rate of 10–500° C./sec. By following up the above procedure, a steel with a tensile strength of 60 kg/mm$^2$ or more with good formability is obtained.

4. Japanese patent laid-open No. Hei-4-228517 and Hei-4-228538 disclose a steel containing 0.15–0.4% by weight of C, 0.5–2.0% by weight of Si, 0.2–2.5% by weight of Mn which is subjected to a finish rolling at a temperature of $Ar_3$±50° C., cooled down to a temperature of $Ar_1$ at a cooling rate of 40° C./sec, and cooled again down to a temperature of 350–400° C. at a cooling rate of 40° C./sec. By following up the above procedure, a steel of which uniform elongation is 20% or more and the value of TS×El. is 2,400 (kg/mm$^2$×%) is obtained.

5. Japanese patent laid-open No. Hei-5-179396 discloses a steel containing 0.18% or less by weight of C, 0.5–2.5% by weight of Si, 0.5–2.5% by weight of Mn, 0.05% or less by weight of P, 0.02% or less by weight of S, and 0.01–0.1% by weight of Al. Additionally 0.02–0.5% by weight of Ti and 0.03–1.0% by weight of Nb can be added. The contents of Nb and Ti are adjusted to % C>(% Ti/4)+(% Nb/8). The steel is finish-rolled at 820° C. or above, held at a temperature of 820–720° C. for 10 seconds or more, cooled down to 500° C. or below at a cooling rate of 10° C./sec, and coiled at this temperature. By following up the above procedure, a steel having high ductility, enhanced fatigue property, a spot weldability, and high strength (70 kg/mm$^2$ or more) is obtained.

6. Japanese patent laid-open No. Hei-5-311323 discloses a steel containing 0.1–0.2% by weight of C, 0.8–21.6% by weight of Si, 3.0–6.0% by weight of Mn, 0.5% or less by weight of Al which is annealed at ferrite/austenite two phase region for 1–20 hours, and furnace cooled to let the volume fraction of retained austenite 10% or more. By following up the above procedure, a steel with the tensile strength of 80 kg/mm$^2$ and superior formability is obtained.

7. Japanese patent laid-open No. Hei-5-112846 discloses a steel containing 0.05–0.25% by weight of C, 0.05–1.0% by weight of Si, 0.8–2.5% by weight of Mn, 0.8–2.5% by weight of Al, which is finish-rolled at a temperature of 780–840° C., cooled down to a temperature of 600–700° C. at a cooling rate of 10° C./sec, air-cooled for 2–10 seconds, and then rapidly cooled down to a temperature of 300–450° C. at a cooling rate of 220° C./sec. By following the above procedure, a steel containing 5% or more by volume of retained austenite is obtained.

A precipitation hardened, hot-rolled dual phase steel has been developed. In this steel, a soft ferrite phase is effectively hardened by the precipitation, and has the tensile strength of 80 kg/mm$^2$ and high ductility (Japanese Iron and Steel Newspaper dated Sep. 4, 1993).

The steels described above have been developed suitably for the intended use, and commercialized. They have a tensile strength of 90 kg/mm$^2$ or less, and corresponding elongations. The hot-rolled steel sheets for use in automobiles are, however, increasingly required to have improved strength as well as good formability.

SUMMARY OF THE INVENTION

The present invention aims at overcoming the aforementioned shortness of the conventional techniques.

Therefore, it is an object of the present invention to provide a more promising method to produce a hot rolled TRIP steel with high strength, high ductility and good formability, in which the basic composition system of the transformation induced plasticity(TRIP) steel is adjusted, i.e. Cu is added to obtain a precipitation hardening effect, and the other producing conditions are controlled.

In order to achieve the above object, the method for manufacturing a hot rolled transformation induced plasticity steel containing Cu, C, Si, Mn and Al and by carrying out a hot rolling, a cooling and a coiling according to the present invention includes the steps of: preparing a steel composed of in weight % 0.15–0.3% of C, 1.5–2.5% of Si, 0.6–1.8% of Mn, 0.02–0.10% of Al, 0.6–2.0% of Cu, 0.6–2.0% of Ni, and a balance of Fe and other inevitable impurities; finish hot-rolling the steel at a temperature of 750–880° C.; initiating a water cooling at a temperature of 680–740° C.; terminating the water cooling at a temperature of 240×(% Mn+% Ni)−140(° C.)≦water cooling terminating temperature≦540° C.; and then coiling.

BRIEF DESCRIPTION OF THE DRAWINGS

The above object and other advantages of the present invention will become more apparent by describing in detail the preferred embodiment so the present invention with reference to the attached drawings in which.

DETAILED DESCRIPTION OF THE PREFERRED EMBODIMENT

Figure 1:
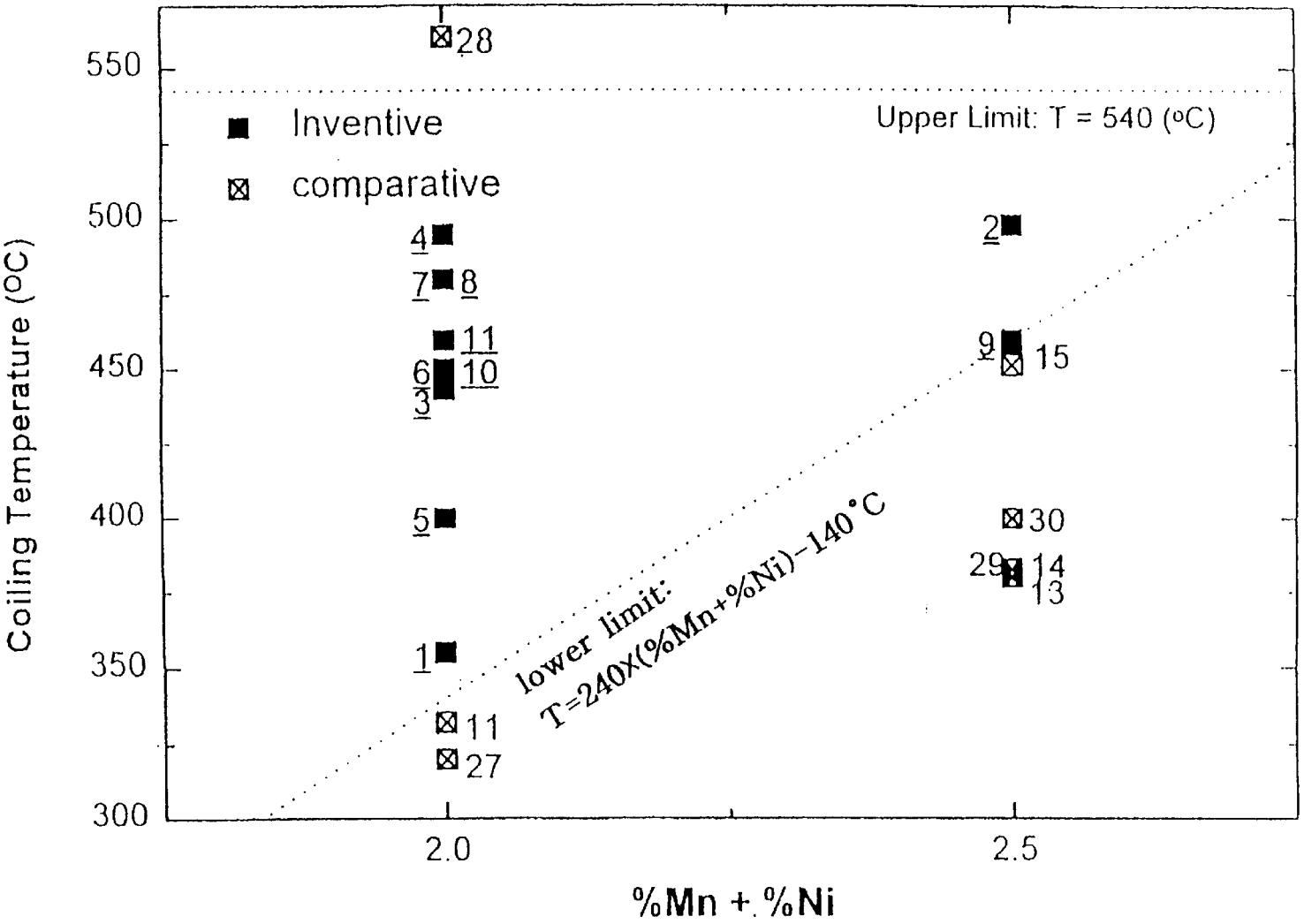
FIG. 1 is graphical illustration showing the relationship between the amount of Mn(wt %)+Ni(wt %) (for obtaining the target properties) and the control range of the water cooling termination temperature.

The present invention includes the following process steps. That is, the method for producing a hot rolled TRIP steel containing Cu, C, Si, Mn and Al etc. is disclosed. The steel comprises 0.15–0.3% by weight of C, 1.5–2.5% by weight of Si, 0.6–1.8% by weight of Mn, 0.02–0.1% by weight of Al, 0.6–2.0% by weight of Cu, and 0.6–2.0% by weight of Ni, the balance being Fe and inevitable impurities. This steel is finish-rolled at a temperature of 750–880° C., slowly cooled down to a temperature of 680–740° C., water cooled, and subsequently, down to a temperature of 240×(% Mn+% Ni)−140° C. to 540° C., i.e. a initiating water cooling at a temperature of 680–740° C. and a terminating water cooling at a temperature of 240×(% Mn+% Ni)−140° C. to 540° C., and finally coiled at this temperature.

First, the reasons why the contents of the ingredients are limited will be described.

Carbon is an element for improving the hardenability. If the content of C is less than 0.15% by weight, then elements such as Cr and Mo have to be added to promote the growth of the low-temperature-transformed phases for obtaining the target properties. In this case, however, the control of the microstructure is difficult, and thence, an improvement of elongation cannot be expected. On the other hand, if C is added by more than 0.3% by weight, the strength can be markedly improved, but the weldability is deteriorated and the steel is embrittled. Therefore, C should be preferably added in an amount of 0.15–0.30% by weight.

Silicon is an element for achieving deoxidation, and is effective for the formation and purification of the ferrite phase that contributes to an increase in the ductility. Therefore, Si plays a decisive role in producing TRIP steel. If Si is added excessively by more than 2.5% by weight, this effect is saturated and the scale properties and the weldability are deteriorated. Thus, the content of Si should be preferably limited to 1.5–2.5% by weight.

Manganese is an element for improving strength and toughness and for stabilizing austenite so as to improve hardenability. Even in the case where Mn is substituted by Ni which is the austenite stabilizing element, if the Mn content is less than 0.6% by weight, then the target properties cannot be obtained. On the other hand, if the Mn content is excessive, the amount of metallic inclusions is increased, and also the center-line segregation occurs during continuous casting procedure. In the present invention, Ni and Mn are compositely added to promote the formation of austenite, thereby obtaining high strength and high ductility.

in this respect, the Mn content should be preferably 0.6–1.8% by weight.

Al is added for deoxidation. This element promotes the formation of ferrite, while it improves the formability. However, in the case of TRIP steel, Al causes degradation of strength. Therefore, Al is added at least by 0.02% by weight or more for the deoxidation. If this element is added excessively, Al-oxides are formed during welding to cause welding defects. Therefore, the upper limit of Al should be preferably 0.10% by weight.

Cu shows a great difference in solubility between high and low temperatures. Therefore, if the steel sheet containing Cu is heat-treated at proper conditions, Cu is precipitated in the form of ϵ—Cu in ferrite grain, which results in strengthening the steel. This feature of Cu can be utilized effectively for strengthening the TRIP steel without significant loss of ductility. In this respect, it is the major feature of the present invention to elicit this property of Cu and to apply it to the practical use. If Cu is added by less than 0.6%, the addition effect is too meager, and the strength becomes low compared with the target properties. On the other hand, if its content is too high, Cu cannot be dissolved in austenite, but segregated on the grain boundary to lower the elongation and to deteriorate the hot workability. Therefore, in order to inhibit the degradation of the elongation and hot workability and to effectively improve the strength, the Cu consent should be preferably limited to 0.6–2.0% by weight.

Ni is an absolutely essential element to prevent hot-shortness which might be caused by Cu addition. Ni is also an element for greatly improving the low temperature toughness of steel. It is, however, an expensive element, and therefore, if it is added too much, the economy is aggravated. Generally Ni is added by half or same as much as that of Cu if one intends to prevent the hot-shortness. Thus, Ni should be preferably added by 0.6–2.0 wt % by weight.

P and S are inevitable impurities in the steel.

P is also an element for promoting the formation of ferrite, and it can improve the ductility without loss of strength of steel. Generally, however, P segregates during continuous casting of the steel, which results in deterioration of the materials properties. Therefore, the content of this element should be preferably maintained as low as possible.

S deteriorates the workability of steel by forming non-metallic inclusions in the form of MnS which are elongated during hot-rolling and can cause the fatal defects such as cracks. Thus, the S content should be preferably controlled as low as possible.

Ca can be added to control the amount of S, in order to prevent the formation of the inclusions and resultantly to improve the reformability. If the Ca content is more than 0.01% by weight, however, this effect is saturated, so that the amount of the inclusion in the form of CaS can be increased. Thus, the Ca should be preferably limited to less than 0.01% by weight.

Now the producing conditions for the present invention will be described.

If the hot rolled steel sheet having aforementioned composition is to be ensured with regard to its strength and ductility, is necessary to control the microstructure of the steel. Thus, finish roll temperature, water cooling initiation temperature and water cooling termination temperature have to be properly controlled.

In carrying out a hot rolling, the finish rolling temperature should be 750–880° C., and the reason is described below.

In the present invention, in order to increase the volume fraction of ferrite and to achieve the fine grains of ferrite for the steel with multiphase structure composed of ferrite, bainite and retained austenite, low temperature rolling should preferably ensue. If the finish rolling temperature is below 750° C., the fraction of deformed ferrites is increased, which results in deterioration of ductility. If the finish rolling temperature, on the other hand, is higher than 880° C., ferrite is not formed at all.

In order to obtain a granular structure without polygonal ferrite, it is required that efficient bainite growth arise during the isothermal holding in the bainite region or after the coiling in the upper bainite region. Further, the effective nucleation site of bainite is the austenite grain boundaries, and therefore, it is needed to increase the area of the austenite grain boundaries during hot rolling procedure. Accordingly, the steel has to be rolled below the dynamic recrystallization temperature of austenite phase.

If the finish rolling temperature is above 880° C., the grain size of austenite is increased, and the austenite is not elongated. As a result, the number of effective nucleation sites for bainite decreases, so that the volume fraction of the retained austenite is diminished. On the other nand, if the finish rolling temperature is below 750° C., polygonal ferrites are formed during the run-out-table stage. Accordingly desirable microstructure of granular structure cannot be obtained. Consequently, the finish rolling temperature should be preferably limited to 750–880° C.

After finish rolling, the water cooling should be initiated preferably after formation of sufficient ferrites before the initiation of the cooling for the multiphase structured steel, which is composed of ferrite, bainite and retained austenite. If the water cooling temperature is too high, ferrites are not sufficiently formed and results in an increase in volume fraction of untransformed austenite which is gradually transformed into a hard phase such as bainite or martensite after cooling down to water cooling termination temperature. This gives rise to an increase in strength, but a significant decrease in ductility. If the water cooling temperature is too low, on the other hand, the pearlite phase is formed, and also deteriorates the mechanical properties of the steel with multi-phase structure. Thus, the water cooling initiation temperature should be preferably limited to 680–740° C. In the case of the steel with granular structure, however, the water cooling initiation temperature should be high enough to prevent the formation of polygonal ferrite. Thus, the water cooling initiation temperature should be higher than 680° C.

The water cooling termination temperature is the most important factor for the producing TRIP steels. In this invention, its upper limit should be preferably 540° C., so that the pearlite would not be formed and the strength would not be greatly decreased even under a slow cooling. Its lower limit should be preferably 240×(% Mn+% Ni)−140° C., since the variations of the properties depend on the contents of Mn and Ni which are effective for stabilizing austenite and enhancing hardenability.

According to the present invention the hot-rolled TRIP steel has a microstructure of multi-phase structure consisting of ferrite, bainite and retained austenite, or granular structure (M-A constituents in bainitic ferrite matrix). Within the ferrite of the mentioned structure, there are fine ϵ—Cu precipitates having size ranges of 5–20 nm.

The multi-phase structure should preferably contain 5–20% by volume of retained austenite, 20–50% by volume of bainite, and a balance of ferrite. If the retained austenite is less than 5 vol %, the improvement of ductility due to strain induced transformation of retained austenite is insufficient. If the retained austenite is more than 20 vol %, on the other hand, retained austenite transforms to martensite even under small strain, and the elongation cannot be improved. If the volume fraction of bainite is less than 20%, strength is lowered. More than 50% by volume of bainite causes strengthening, but aggravating ductility and formability.

The granular structure should preferably contain 40–60% by volume of M-A(martensite-austenite) constituents in ferrite matrix. If the volume fraction of M-A constituents is less than 40%, strength is lowered. If it is more than 60%, strength is improved, but ductility is significantly aggravated.

The volume fraction of the retained austenite within M-A constituents should be preferably-limited to 10–40% by volume. The reason is as follows. If it is less than 10%, the improvement of elongation due to strain induced transformation of retained austenite is insufficient. If it is more than 40%, on the other hand, retained austenite transforms to martensite even under small strain, and hence the elongation cannot be improved.

In the present invention, microstructure of the steel is controlled by controlling the finish rolling temperature, the water cooling initiation temperature and the water cooling termination temperature.

Now the present invention will be described based on actual examples.

EXAMPLE 1

Steel slabs having compositions of Table 1 below were heated up to a temperature of 1200° C., and then, hot-rolled into a final thickness of 3.0 mm.

Figure 2:
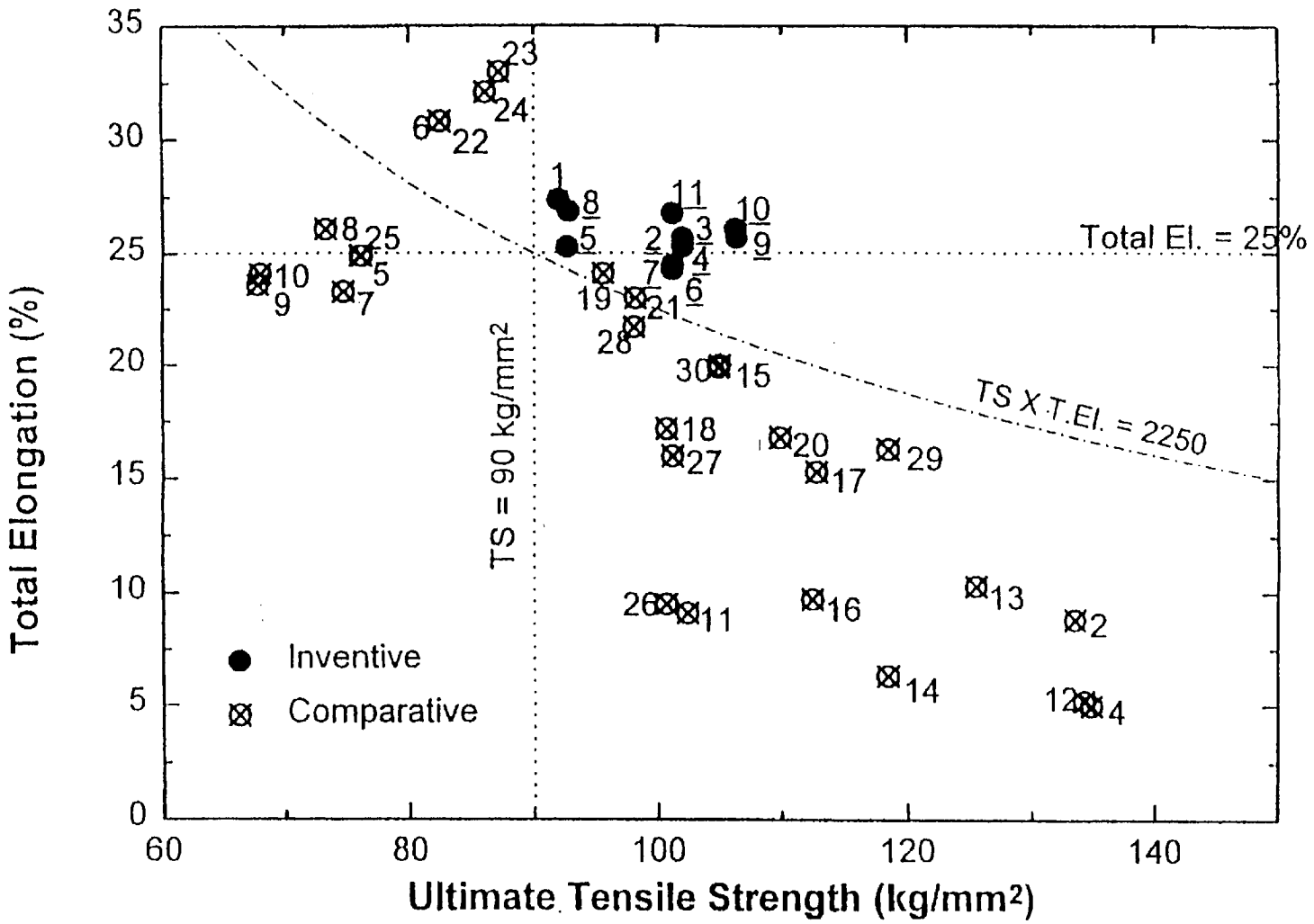
FIG. 2 is a graphical illustration showing the relationship between the tensile strength and the elongation.
Figure 3:
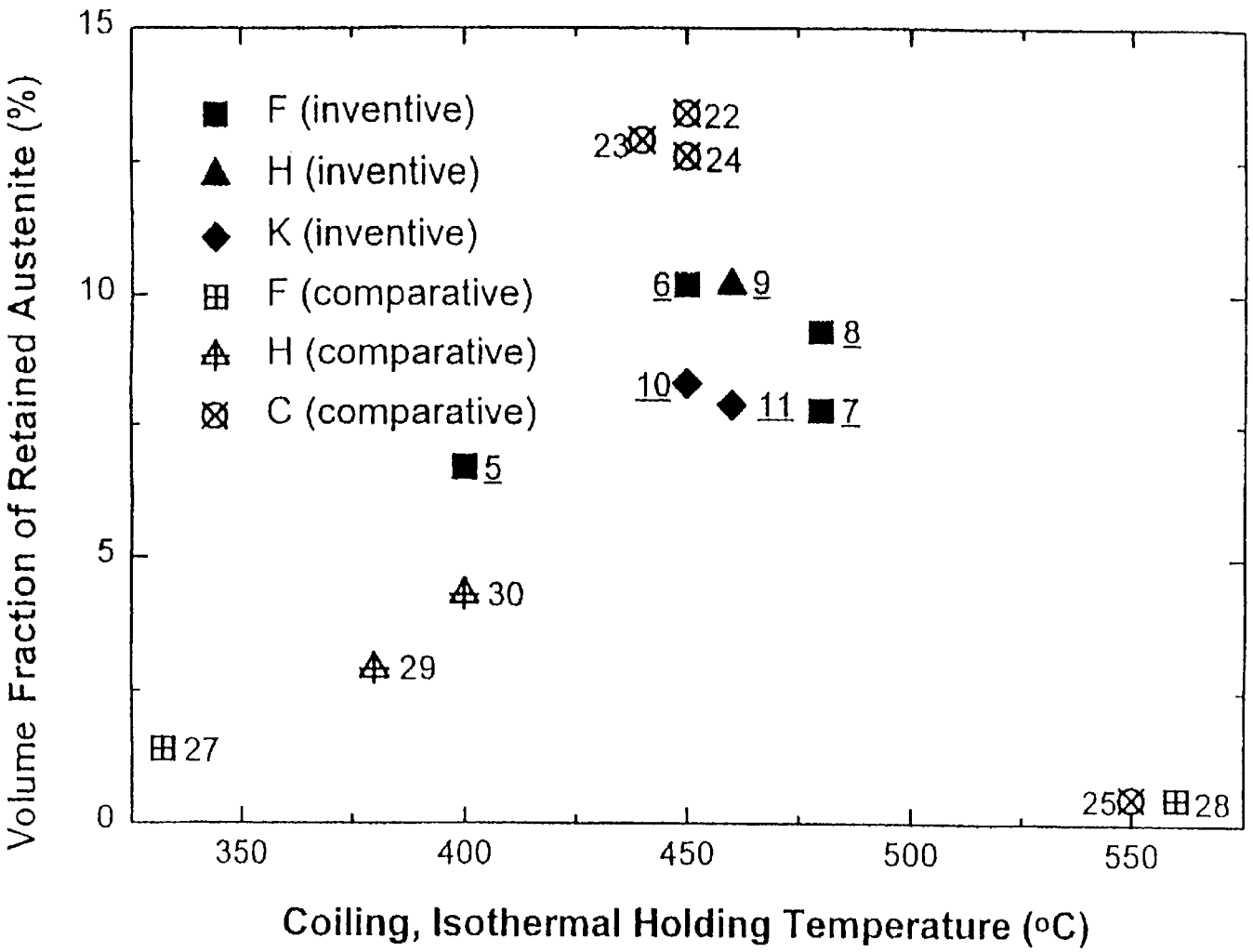
FIG. 3 is a graphical illustration showing the relationship between the isothermally held coiling temperature and the volume fraction variation of the retained austenite.
Figure 4:
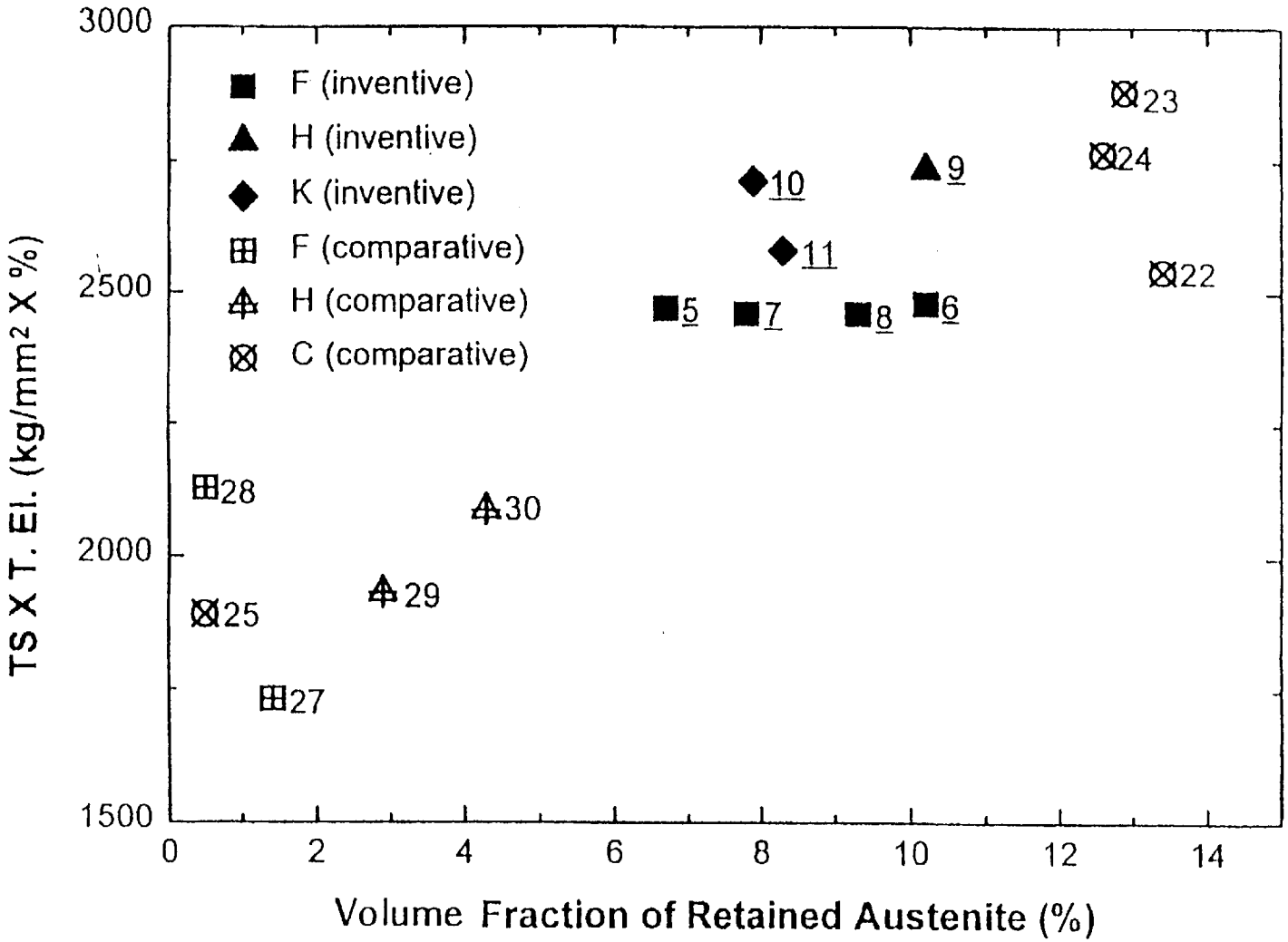
FIG. 4 is a graphical illustration showing the variation of tensile strength×total elongation versus the volume fraction of the retained austenite.

As shown in Table 2 below, the finish hot rolling temperature was 720–900° C. as shown in Table 2, and water cooling was initiated at the temperature of 650–780° C. for controlling the cooling. The water cooling was finished at 300–620° C. which is the water cooling termination temperature (CF). The last temperature range corresponds to the coiling temperature in a hot rolling. That is to say, after hot rolling, a rapid cooling was carried out by a roll quenching, and followed by an air cooling for a certain period of time so as to vary the water cooling initiation temperature. Then the steel sheets were transferred to a simulator. In this simulator, the water cooling termination temperature was adjusted by the water cooling. Then the steel sheets were hot-coiled using intra-furnace cooling, and slow cooling began. During this process, a simulation was carried out. The hot rolled steel sheets by this process tested the tensile strength and the results were in Table 2 below and FIG. 2.

TABLE 1

| Steel | C | Si | Mn | P | S | Al | Cr | Ni | Mo | Cu | Remarks |
|---|---|---|---|---|---|---|---|---|---|---|---|
| A | 0.61 | 2.00 | 1.00 | 0.017 | 0.003 | 0.051 | — | — | — | — | Comparative steel |
| B | 0.39 | 1.98 | 1.47 | 0.014 | 0.004 | 0.051 | — | — | — | — | Comparative steel |
| C | 0.19 | 2.01 | 1.53 | 0.017 | 0.004 | 0.040 | — | — | — | — | Comparative steel |
| D | 0.20 | 1.94 | 0.51 | 0.016 | 0.005 | 0.036 | — | 1.01 | — | — | Comparative steel |
| E | 0.20 | 1.02 | 0.50 | 0.015 | 0.003 | 1.00 | — | 1.01 | — | — | Comparative steel |
| F | 0.20 | 2.00 | 1.01 | 0.017 | 0.004 | 0.034 | — | 1.01 | — | 1.20 | Inventive steel |
| G | 0.10 | 1.97 | 1.50 | 0.018 | 0.004 | 0.043 | 0.51 | 1.03 | 0.30 | 1.20 | Comparative steel |
| H | 0.20 | 1.91 | 1.53 | 0.015 | 0.004 | 0.039 | — | 1.03 | — | 1.26 | Inventive steel |
| I | 0.20 | 1.94 | 1.50 | 0.014 | 0.004 | 0.040 | — | 1.00 | — | — | Comparative steel |
| J | 0.20 | 1.88 | 1.51 | 0.015 | 0.004 | 0.042 | — | — | — | 1.21 | Comparative steel |
| K | 0.20 | 1.97 | 1.01 | 0.015 | 0.004 | 0.003 | — | 1.01 | — | 1.80 | Inventive steel |
| L | 0.20 | 1.95 | 1.51 | 0.016 | 0.004 | 0.040 | — | 0.51 | — | 0.595 | Comparative steel |

TABLE 2

| | | Temperatures during rolling and cooling | | | Tensile properties | | |
|---|---|---|---|---|---|---|---|
| Test piece No. | | FRT (° C.) | CS (° C.) | CF (° C.) | Tensile strength (TS) (kg/mm$^2$) | Elongation (E1) (%) | Steel No. |
| Comparative material | 1 | 800 | 694 | 305 | 166.7 | 2.1 | A |
| | 2 | 747 | 676 | 400 | 133.7 | 8.8 | |
| | 3 | 802 | 692 | 356 | 153.0 | 3.6 | B |
| | 4 | 747 | 676 | 307 | 135.0 | 5.0 | |
| | 5 | 806 | 726 | 563 | 76.1 | 24.9 | C |
| | 6 | 799 | 718 | 447 | 82.5 | 30.8 | |
| | 7 | 835 | 751 | 604 | 74.7 | 23.3 | D |
| | 8 | 798 | 726 | 466 | 73.3 | 26.1 | |
| | 9 | 843 | 758 | 559 | 67.8 | 23.6 | E |
| | 10 | 806 | 712 | 470 | 68.0 | 24.1 | |
| | 11 | 748 | 691 | 332 | 100.7 | 9.5 | F |
| Inventive material | 1 | 769 | 691 | 355 | 92.0 | 27.4 | |
| Comparative material | 12 | 799 | 722 | 300 | 134.3 | 5.2 | G |
| | 13 | 746 | 663 | 300 | 125.6 | 10.3 | |
| | 14 | 844 | 680 | 383 | 118.5 | 6.3 | H |
| | 15 | 797 | 702 | 459 | 104.9 | 19.9 | |
| Inventive material | 2 | 801 | 702 | 498 | 106.3 | 26.1 | |
| Comparative material | 16 | 820 | 717 | 330 | 112.5 | 9.7 | I |
| | 17 | 797 | 624 | 387 | 109.9 | 16.8 | |
| | 18 | 855 | 736 | 415 | 101.2 | 16.0 | J |
| | 19 | 799 | 715 | 396 | 95.6 | 24.1 | |
| Inventive material | 3 | 854 | 734 | 443 | 102.0 | 25.3 | K |
| | 4 | 798 | 698 | 495 | 101.2 | 26.8 | |
| Comparative | 20 | 849 | 730 | 302 | 112.8 | 15.3 | L |

TABLE 2-continued

| Test piece No. | | Temperatures during rolling and cooling FRT (° C.) | CS (° C.) | CF (° C.) | Tensile properties Tensile strength (TS) (kg/mm²) | Elongation (E1) (%) | Steel No. |
|---|---|---|---|---|---|---|---|
| material | 21 | 803 | 708 | 440 | 98.2 | 23.0 | |

As shown in Tables 1 and 2 above, the comparative materials 1–4 were produced using the comparative steels A and B containing a large amount of C. In these cases, the tensile strength was as high as 130 kg/mm$^2$, but elongation was as low as 10% or less. Thus they do not have sufficient formability.

The comparative material 5 was produced using the comparative steel C (of which composition is known as typical TRIP steel) with proper conditions. In this case, tensile strength was 82.5 kg/mm$^2$ and elongation was 30.8%, equivalent to the previously studied hot-rolled TRIP steels. The comparative material 6, however, contains pearlite phase in the microstructure due to the higher water cooling termination temperature, and tensile strength was lowered down to 76.1 kg/mm$^2$ and elongation was lowered to 24.9%.

The comparative materials 7 and 8 were produced using the comparative steel D in which Mn was partly substituted by Ni, and tensile strength of them was about 75 kg/mm$^2$, too low compared to the target properties. The comparative materials 9 and 10 were produced using the comparative steel E in which Si was partly substituted by Al, and the tensile strength of them was further lowered. The comparative materials 12 and 13 were produced using the comparative steel G in which the content of C was lowered to 0.1% by weight, and in which Cr and Mo were added to promote a low temperature transformation so as to compensate the decrease in the content of C. In these cases, tensile strength was significantly improved, but elongation was greatly lowered. Thus, these materials are not suitable for press-forming steels.

The comparative materials 16 and 17 were produced using the comparative steel I in which Ni was added without decreasing Mn content. In these cases, tensile strength was as high as 110 kg/mm$^2$, but elongation was lowered down to 17% or less. Thus, these materials are not suitable for press-forming steels.

The comparative materials 18 and 19 were produced using the comparative steel J in which Cu was singly added. In these cases, elongation was far below the target property. The comparative materials 20 and 21 were produced using the comparative steel L in which Ni and Cu were added in 0.5% and 0.6% respectively. In these cases, the balance of strength and elongation was slightly below the target property.

The mechanical properties of the inventive material 1, of which the composition is listed in Table 1 (steel F) within the range of the present invention, and which was hot-rolled and cooled referring to the present invention, were tensile strength more than 90 kg/mm$^2$ and elongation more than 27%.

The inventive material 2 was produced using the inventive steel H in which the content of Mn was increased up to 1.5% by weight unlike in the inventive steel F. This steel was hot-rolled and cooled referring to the present invention. The mechanical properties of this steel were 100 kg/mm$^2$ tensile strength and more than 26% elongation.

The inventive materials 3 and 4 were produced by controlling the hot rolling conditions and cooling conditions referring to the present invention, by using the inventive steel K in which Cu was added by 1.8% by eight. These steels showed superior combination of strength and elongation, more than 100 kg/mm$^2$ tensile strength and more than 25% elongation.

Superior combination of strength and elongation, more than 90 kg/mm$^2$ tensile strength and more than 25% elongation could be successfully obtained by nmodifying the alloy composition and by controlling the producing conditions in the present invention.

Even in the cases of the inventive steels F, H and K, if the hot rolling conditions were not optimized, the target properties could not be obtained (as in the comparative materials 11, 14 and 15). The factor which has the greatest influence on the properties was the water cooling termination temperature. In the case where the water cooling termination temperature is varying with the contents of Mn and Ni, if the target properties are to be obtained, the water cooling termination temperature should be maintained at a temperature of 240×(% Mn+% Ni)−140° C. to 550° C., as shown in FIG. 1. If the water cooling termination temperature is lower than the above condition, tensile strength is improved, but elongation is greatly aggravated, which results in degradation of formability. If cooling termination temperature is raised higher than upper limit, strength and elongation are aggravated by the formation of pearlite phase. Thus, the water cooling termination temperature should be maintained below the pearlite forming temperature. During the continuous cooling of the inventive steels F, H and K, pearlite transformation temperatures were monitored using dilatometer. The result showed that the transformation temperature were 548, 556 and 561° C., closely similar to one another. Thus, it was found that the water cooling termination temperature had to be confined within the range where pearlite phases are not formed.

EXAMPLE 2

Slabs of the comparative steel C and the inventive steels F, H and K, which are shown in Table 1, were heated up to a temperature of 1200° C.

As shown in Table 3 below, the final hot rolling temperature was 720–900° C., and water cooling was initiated at the temperature of 650–780° C. for controlling the cooling. The water cooling was finished at 300–560° C. which is the water cooling termination temperature (CF). The last temperature range corresponds to the coiling temperature in a hot rolling. That is to say, after hot rolling, a rapid cooling was carried out by a roll quenching, and followed by an air cooling for a certain period of time so as to vary the water cooling initiation temperature. Then the steel sheets were transferred to a simulator. In this simulator, the water cooling termination temperature was adjusted by the water cooling. Then the steel sheets were hot-coiled using intra-furnace cooling, and slow cooling began. During this process, a simulation was carried out. The hot rolled steel sheets by this process tested the tensile strength and the results were in Table 4 below.

Further, volume fraction of retained austenite, tensile strength×total elongation (TS×T.El.) and microstructure were examined and the results were in Table 4 below and FIGS. 2–6.

TABLE 3

| Test piece No. | Temperature during rolling and cooling FRT (° C.) | CS (° C.) | CF (° C.) | Steel No. |
|---|---|---|---|---|
| Comparative material 22 | 799 | 718 | 450 | Comparative steel C |
| Comparative material 23 | 795 | 695 | 440 | Comparative steel C |
| Comparative material 24 | 786 | 716 | 450 | Coaiparative steel C |
| Comparative material 25 | 808 | 726 | 550 | Comparative steel C |
| Comparative material 26 | 797 | 716 | 320 | Inventive steel F |
| Comparative material 27 | 769 | 691 | 332 | Inventive steel F |
| Inventive material 5 | 748 | 691 | 400 | Inventive steel F |
| Inventive material 6 | 795 | 716 | 450 | Inventive steel F |
| Inventive material 7 | 799 | 702 | 480 | Inventive steel F |
| Inventive material 8 | 800 | 700 | 480 | Inventive steel F |
| Comparative material 28 | 801 | 700 | 560 | Inventive steel F |
| Comparative material 29 | 844 | 680 | 380 | Inventive steel H |
| Comparative material 30 | 797 | 702 | 400 | Inventive steel H |
| Inventive material 9 | 801 | 702 | 460 | Inventive steel H |
| Inventive material 10 | 854 | 734 | 450 | Inventive steel H |
| Inventive material 11 | 798 | 698 | 460 | Inventive steel H |

As shown in Table 4 above, the inventive materials 5–11 produced by invention process conditions using the steel of the aresent invention showed 90 kg/mm$^2$ and over 20% elongation. Furthermore, the evaluation index of the hole expansion ratio was 58–62%, and it represents that the steel sheet has high strength, elongation and formability.

The inventive materials 7 and 8 which have the granular structure showed low formability evaluation index (tensile strength×elongation) compared with the inventive material 5 of the multi-phase structure. However, they showed a high hole expansion ratio. Meanwhile, in case of the inventive material 9, high elongation and strength were obtained, and the hole expansion ratio was superior.

Figure 5:
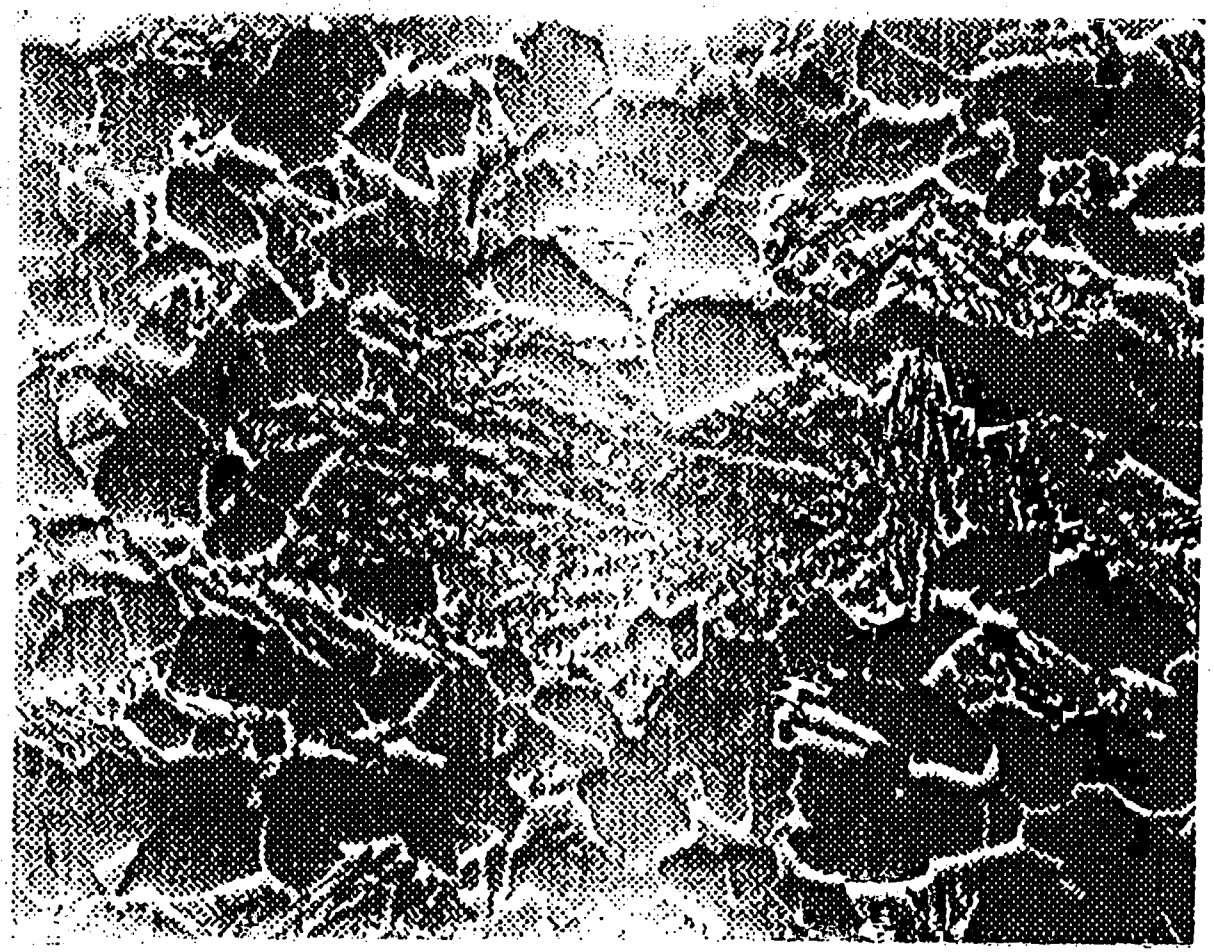
FIG. 5 is an example of a microstructure of the hot rolled TRIP steel according to the present invention.
Figure 6:
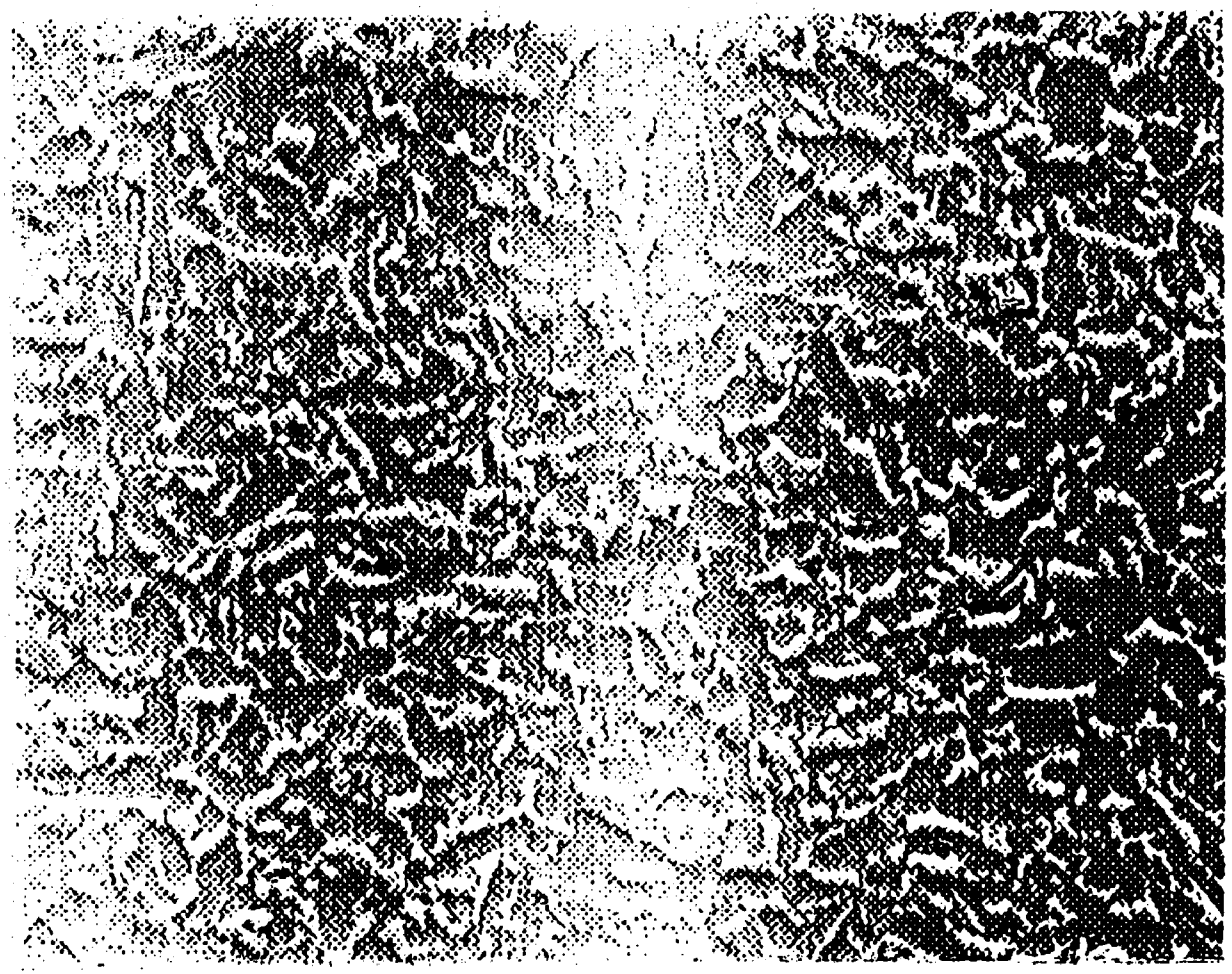
FIG. 6 is another example of a microstructure of the hot rolled TRIP steel according to the present invention.

FIG. 5 shows the microstructure of the inventive material 5, and FIG. 6 shows the microstructure of the inventive material 9.

According to the present invention above, the transformation induced plasticity steel can be obtained by adding Cu to the matrix, and controlling the manufacture conditions.

As a result, a hot rolled transformation induced steel by this process showed over 90 kg/mm$^2$ tensile strength.

Therefore, this invention can be applied to the materials which need high tensile strength, high elongation and formability.

What is claimed is:

1. A method for manufacturing a hot rolled transformation induced plasticity steel containing Cu, C, Si, Mn and Al and by carrying out a hot rolling, a cooling and a coiling, comprising the steps of:

preparing a steel consisting essentially of in weight % 0.15–0.3% C, 1.5–2.5% Si, 0.6–1.8% Mn, 0.02–0.10% Al, 0.6–2.0% Cu, 0.6–2.0% Ni, 0–0.01% Ca, balance Fe and inevitable impurities;

finish hot rolling the steel at a temperature of 750–880° C.;

TABLE 4

| Test piece No. | | VR (%) | Yield strength (YS) (kg/mm$^2$) | Tensile strength (UTS) (kg/mm$^2$) | Elongation (U, El.) (%) | Total elongation (T. E1.) (%) | TS × T. El. (kg/mm$^2$ × %) | λ * (%) | micro-structure |
|---|---|---|---|---|---|---|---|---|---|
| Comparative material | 22 | 13.4 | 55.6 | 82.5 | 23.4 | 30.8 | 2541.0 | 52 | B |
| | 23 | 12.9 | 49.4 | 87.2 | 22.2 | 33.0 | 2879.6 | 55 | G |
| | 24 | 12.6 | 55.4 | 86.1 | 29.0 | 32.1 | 2763.8 | 53 | G |
| | 25 | — | 62.0 | 76.0 | 18.5 | 24.9 | 1892.4 | — | P |
| | 26 | 2.3 | 72.1 | 102.4 | — | 9.1 | 931.8 | — | M |
| | 27 | 1.4 | 82.3 | 100.7 | 11.3 | 17.2 | 1732.0 | — | M |
| Inventive material | 5 | 6.7 | 62.8 | 92.8 | 23.1 | 26.9 | 2469.3 | 58 | B |
| | 6 | 10.2 | 76.3 | 101.2 | 20.0 | 24.5 | 2479.4 | 59 | G |
| | 7 | 7.8 | 42.7 | 101.2 | 20.4 | 24.3 | 2459.2 | 60 | G |
| | 8 | 9.3 | 46.5 | 92.7 | 18.4 | 25.3 | 2345.3 | 60 | G |
| Comparative material | 28 | — | 48.8 | 98.1 | 17.4 | 21.7 | 2128.8 | 48 | P |
| | 29 | 2.9 | 97.7 | 118.5 | — | 16.3 | 1932.3 | — | M |
| | 30 | 4.3 | 72.0 | 104.9 | 13.9 | 19.9 | 2087.5 | — | M |
| Inventive material | 9 | 10.2 | 66.9 | 106.4 | 19.1 | 25.7 | 2734.5 | 65 | G |
| | 10 | 8.3 | 73.3 | 102.0 | 16.8 | 25.7 | 2580.6 | 60 | G |
| | 11 | 7.9 | 63.3 | 101.2 | 19.7 | 26.8 | 2712.2 | 58 | B |

where,

λ*: Hole expansion ratio

VR: Volume fraction of retained austenite(%)

B: Multi-phase structure consisting of ferrite+bainite +retained austenite.

G: Granular structure

M: Ferrite+martensite structure

P: Ferrite+pearlite structure initiating a water cooling at a temperature of 680–740° C.;

terminating the water cooling at a temperature of 240×(% Mn+% Ni)−140(° C.)≦water cooling terminating temperature ≦540° C.; and then coiling, wherein the hot rolled transformation induced plasticity steel has a multi-phase structure consisting of ferrites bainites and retained austenites, and fine ϵ—Cu precipitates having sizes of 5–20 nm are present in the ferrites.

2. The method as claimed in claim 1, wherein the hot rolled transformation induced plasticity steel has a structure consisting of 5–20 vol % of retained austenites, 20–50 vol % of bainites, and a balance of ferrites.

3. The method as claimed in claim 1, wherein the hot rolled transformation induced plasticity steel has a granular structure consisting of a bainitic-ferrite matrix containing a martensite-retained austenize mixture; and fine ϵ—Cu precipitates having sizes of 5–20 nm are contained in the ferrites.

4. The method as claimed in claim 3, wherein the martensite-retained austenite mixture is present in a volume percentage of 40–60 vol %.

5. The method as claimed in claim 4, wherein the martensite-retained austenite mixture contains the retained austenites in a volume percentage of 10–40 vol %.

* * * * *

UNITED STATES PATENT AND TRADEMARK OFFICE

CERTIFICATE OF CORRECTION

PATENT NO. : 6,190,469 B1
DATED : February 20, 2001
INVENTOR(S) : Hyang Jin Koh et al.

It is certified that error appears in the above-identified patent and that said Letters Patent is hereby corrected as shown below:

Title Page,
Refer to (22) PCT Filing Date: "Jan. 11, 1997" should read -- Nov. 4, 1997 --.

Column 1,
Line 8, "Apr. 11, 1997" should read -- Nov. 4, 1997 --.
Line 23 "And order" should read -- In order --

Column 2,
Line 17, "austerite" should read -- austenite --.
Line 34, "cooling raze" should read -- cooling rate --.

Column 5,
Line 1, "in this" should read -- In this --.
Line 50, "reformability" should read -- formability --.

Column 6,
Line 21, "nand" should read -- hand --.

Column 7,
Line 40, between "preferably" and "limited" delete hyphen (-).

Column 8,
Table 1, column "A1", row "K": "0.003" should read -- 0.033 --

Column 10,
Line 6, "by eight" should read -- by weight --.
Line 12, "nmodifying" should read -- modifying --.
Line 36 "temperature" should read -- temperatures --.

Column 11,
Table 3, column entitled "Steel No.", third row, "Coaiparative" should read -- Comparative --.

UNITED STATES PATENT AND TRADEMARK OFFICE

CERTIFICATE OF CORRECTION

PATENT NO. : 6,190,469 B1
DATED : February 20, 2001
INVENTOR(S) : Hyang Jin Koh et al.

It is certified that error appears in the above-identified patent and that said Letters Patent is hereby corrected as shown below:

Column 12,
Line 3, "aresent" should read -- present --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*